United States Patent [19]

Rama

[11] 4,355,803

[45] Oct. 26, 1982

[54] TENNIS RACQUET WITH VARIABLE CENTER OF GRAVITY AND BALANCE

[75] Inventor: Lord Rama, Rosendale, N.Y.

[73] Assignee: Coin-Operated Exercise Equipment Co. Inc., Carmel, N.Y.

[21] Appl. No.: 218,540

[22] Filed: Dec. 22, 1980

[51] Int. Cl.[3] ..... A63B 49/00

[52] U.S. Cl. ..... 273/73 J

[58] Field of Search ..... 273/73 R, 73 C, 73 G, 273/73 H, 73 J, 80 D, 80.1, 81.2, 171; 177/246, 250, 251

[56] References Cited

U.S. PATENT DOCUMENTS

| | | | |
|---|---|---|---|
| 1,587,918 | 6/1926 | Morrison | 273/73 J |
| 2,546,140 | 3/1951 | Tynan et al. | 273/73 J |
| 3,315,532 | 4/1967 | Carnesecca et al. | 273/81.2 X |
| 3,931,968 | 1/1976 | Hedberg | 273/81.2 X |
| 4,027,881 | 6/1977 | Hufenus | 273/73 G |
| 4,052,060 | 10/1977 | Balkcom | 273/73 G X |

FOREIGN PATENT DOCUMENTS

| | | | |
|---|---|---|---|
| 15733 | 12/1933 | Australia | 273/73 J |
| 218423 | 7/1924 | United Kingdom | 273/73 J |

*Primary Examiner*—Anton O. Oechsle
*Attorney, Agent, or Firm*—Kenneth E. Macklin

[57] ABSTRACT

A tennis racquet with variable center of gravity and balance which comprises (a) a head, a handle and a grip, with the handle comprised of two side frames, (b) a weighted mechanism slidably mounted between the two side frames, and (c) ball and detent means between the weighted mechanism and the side frames for readily maintaining the position of the weighted mechanism at intermediate positions between head and grip as the weighted mechanism is slid back and forth between the head and the grip, thereby shifting the center of gravity and the balance toward the head or the grip.

3 Claims, 3 Drawing Figures

FIG. 1
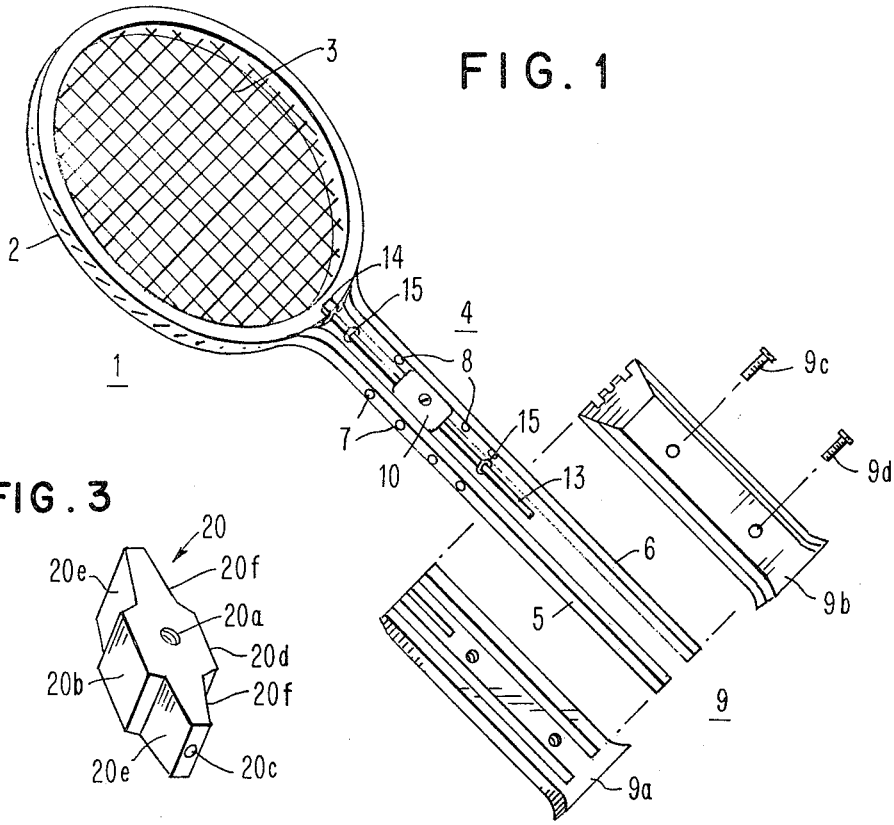
FIG. 3
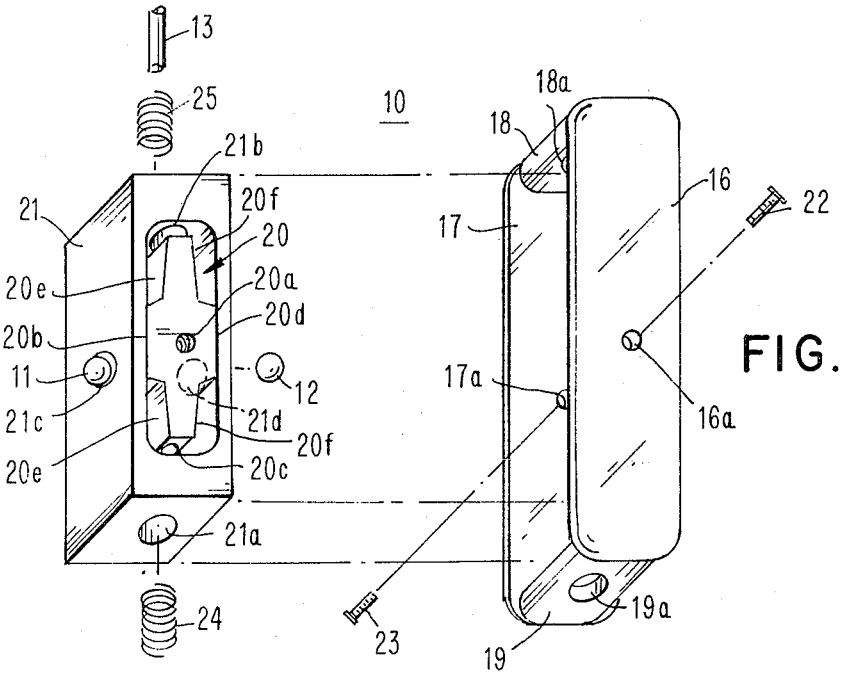
FIG. 2

TENNIS RACQUET WITH VARIABLE CENTER OF GRAVITY AND BALANCE

The present invention relates to a tennis racquet whose center of gravity or balance can be readily varied between the head and grip of the racquet as the player uses the racquet.

BACKGROUND OF THE INVENTION

The choice of balance and weight of a racket always poses a problem to the tennis player. In fact, a so-called "head-balanced" racket, i.e., one whose center of gravity is located towards the head of the racket, is more suitable for base-line play and for service, whereas the so-called "head-light" racket, i.e., whose center of gravity is located towards the grip of the racket, is more suitable for volleying.

These two advantages sought according to the various phases of play being incompatible, the player must select one of these two types of balance, but he may also accept a compromise solution and select a racket called "well-balanced", that is to say a racket whose center of gravity occupies a middle position between the head and the grip of the racket, such a racket then not having any particular advantage for one type of play over another.

DESCRIPTION OF THE PRIOR ART

Many approaches have been taken to adapt a racquet so that is has variable balance or weight.

Four patents—U.S. Pat. Nos. 4,027,881; 2,546,140; 3,912,268; and 4,179,121—describe the use of a moveable member between the head and grip. Two patents—U.S. Pat. Nos. 3,931,968 and 3,833,219—describe the use of grips which can be moved toward or away from the head of the racquet. Two patents—U.S. Pat. Nos. 3,642,283 and 3,625,512—describe the use of weights on the racquet head.

U.S. Pat. No. 4,027,881 shows several variations on the theme of a weight moving along a single guide rod which extends between the head and grip and which has recesses in it to accept a spring-loaded pin or ball in the weight. The pin or ball serves to immobilize the weight where desired. The patent also describes weighting the head.

U.S. Pat. No. 2,546,140 shows a racquet having adjustable weighting means. In one embodiment, shown in FIGS. 1 and 4 of that patent, one or more weights 40 may be attached at different locations on the shafts joining the head and grips. At least a screwdriver is required to accomplish the adjustment. In the other embodiment, shown in FIGS. 2 and 3 of that patent, a third, central tubular shaft runs between the two shafts joining the head and grip of the racquet. In the shaft there is a movable weight attached to an endless cord loop which passes through an eyelet near the head of the racquet and which also passes through a cap nut at the end of the grip. The part of the loop which passes through the cap nut may be used to slide the weight inside the cylinder toward or away from the head of the racquet. When the weight is in the desired place, the loop is held in place by means of friction by placing a cap over the cap nut.

U.S. Pat. No. 3,912,268 shows a racquet having a lateral strut positioned between the head and the grip. There is apparently no effect on balance and weight, which "are essentially the same as the Seamless AR-2."

U.S. Pat. No. 4,179,121 shows a racquet having a plate in its throat with a longitudinal slot in the plate. The counter-weight is a small clamp that includes a bolt and an adjustment wing nut that is slidably set in the slot.

U.S. Pat. No. 3,931,968 shows a racquet having an adjustable grip, i.e., the grip may be moved toward or away from the head. Two configurations are shown. In one, there is a detent plate in the grip between the parallel parts of the frame and a latching ball mounted on a leaf spring opposite the holes in the detent plate. In use, the grip is moved toward or away from the head and pressure is exerted on the grip by the player's hand so as to force the ball into a hole in the detent plate and thereby immobilize the grip at a desired location. A thumb screw is also provided so that the grip may be fixed in place without the need to squeeze the handle. In the other configuration, there is a chisel-shaped cam which is spring-biased so as to ordinarily press the movable latching balls into detent notches. A button is provided in the grip so as to move the cam away from the latching balls, allowing them to fall free of the detent notches, and allowing the grip to be moved toward or away from the head of the racquet.

U.S. Pat. No. 3,833,219 shows a racquet which may be adjusted to different players by use of hand tools. The grip may be placed at different locations on the extensions of the frame, either toward or away from the head, and then bolted in place. The perimeter of the grip can be adjusted for different sizes of hands by using spacer disks between the grip pallet members. If those disks are of dense material, they will function to weight the grip, as will additional bolts and nuts used in the ordinarily unused additional adjusting holes in the frame and grip members. A weighted slug with holes in it may be mounted on the head of the racquet, by means of screws driven into threaded holes in the frame of the racquet.

U.S. Pat. No. 3,642,283 describes the use of weight slugs of lead, zinc or polyethylene, chosen depending on weighting desired. The slug is a strip with string holes which is placed next to the bridge which closes the throat of the racquet, on the side of the bridge toward the grip. Over the slug and completely enclosing it with the bridge is a one piece throat string cushion of U-shaped cross section and with molded-in grommets which fit through the string holes in the slug and the bridge.

U.S. Pat. No. 3,625,512 describes a racquet having an extruded metal frame with a channel in its outside perimeter. A flexible strip is placed into that channel in the area where the strings go through holes in the racquet head. The flexible strip functions to provide balance and weight control and to protect the strings from abrasion, moisture or dirt. The flexible strip may also accommodate additional supplemental weights.

SUMMARY OF THE INVENTION

It is an object of this invention to provide improved means for adjusting the center of gravity and balance of a tennis racquet.

It is also an object of this invention to provide a tennis racquet with a weighted mechanism that may be readily moved during play to change the center of gravity and balance of the racquet to the optimum position for the type of stroke to be made.

It is a further object of this invention to provide such weighted mechanisms in different weights to accommodate different racquets and the desires of different tennis players.

Generally, the tennis racquet of this invention comprises (a) a head, a handle, and a grip, with the handle comprised of two side frames, (b) a weighted mechanism slidably mounted between the two side frames, and (c) ball and detent means between the weighted mechanism and the side frames for readily maintaining the position of the weighted mechanism at intermediate positions between head and grip as the weighted mechanism is slid back and forth between the head and the grip, thereby shifting the center of gravity and the balance toward the head or the grip.

BRIEF DESCRIPTION OF THE DRAWINGS

FIG. 1 illustrates a preferred embodiment of the tennis racquet of this invention with the slidable weighting mechanism between head and grip, with the grip pallet members shown in exploded fashion.

FIG. 2 is an exploded view of the weighted mechanism of the racquet of this invention.

FIG. 3 shows the cross-shaped cam contained in the slidable weighting mechanism.

DESCRIPTION OF THE PREFERRED EMBODIMENTS

In FIG. 1 the preferred tennis racquet 1 of this invention is illustrated. It is comprised of a head 2 which is conventionally strung 3, a handle 4 which is comprised of a pair of side frames 5 and 6 which have corresponding located sets of holes 7 and 8 to act as detents, and a grip 9 comprised of pallets 9*a* and 9*b*, held together by screws 9*c* and 9*d*. Between the side frames 5 and 6 comprising the handle 4 is a weighted mechanism 10, which is slidably mounted between the side frames 5 and 6 of the handle 4. Either side of the weighted mechanism 10 contains a ball 11 or 12 which corresponds to the sets of detent holes 7 and 8 in the side frames 5 and 6 of the handle 4. The weighted mechanism 10 is also preferably slidably mounted on a rod 13 (of uniform cross section) which is centrally and longitudinally located between the side frames 5 and 6 of the handle 4. The weighted mechanism 10 slides on rod 13 by means of a passage of corresponding cross section longitudinally within the weighted mechanism 10. One end of the rod 13 is secured within the grip 9 and the other end is secured to the base of the head 2 by means of a U-shaped holder 14 which is riveted to the base of the head 2. A rubber O-ring 15 is at either end of the rod 13 between the grip 9 and the head 2. The O-rings 15 act as shock absorbers when the weighted mechanism 10 reaches those limits. In use, even while the player is running, the player holds the racquet 1 by the grip 9 with one hand in the usual manner and reaches for the weighted mechanism 10 with the other hand, grasping the weighted mechanism 10 by the top and bottom gripper plates 16 and 17 respectively between the thumb on the upper gripper plate 16 and the other fingers on the bottom gripper plate 17.

FIG. 2 is an exploded view of the weighted mechanism 10 showing the gripper plates 16 and 17 which are separated by spacer bars 18 and 19 to which they are riveted. The spacer bars 18 and 19 have holes 18*a* and 19*a* drilled through them to serve as a passage for the rod 13 which is preferably of circular cross section. FIG. 3 illustrates cross-shaped cam 20. Cross-shaped cam 20 has threaded holes 20*a* and 20*g* (not visible) top and bottom respectively and has a longitudinal passage 20*c* for rod 13. Cross-shaped cam 20 is nested within sliding detent box 21, which is open top and bottom. The cross-shaped cam 20 nested in the sliding detent box 21 is placed in the space between the gripper plates 16 and 17. The gripper plates 16 and 17 have centrally located holes 16*a* and 17*a*, which are the same diameter as the heads of machine screws 22 and 23. The screws 22 and 23 are placed in the holes in the gripper plates and then are respectively screwed into the threaded holes 20*a* (top) and 20*g* (bottom—not visible) in the cross-shaped cam 20, securing the cross-shaped cam 20 to the gripper plates 16 and 17 by means of the heads of the machine screws 22 and 23 which function as a kind of axle in the holes 16*a* and 17*a* of gripper plates 16 and 17.

The sliding detent box 21 has holes 21*a* and 21*b* in either end on its longitudinal axis, which again serve as a passage for rod 13, and holes 21*c* and 21*d*, which act as detent holes. Compression springs 24 and 25 also serve as a passage for rod 13 and are assembled on the longitudinal axis of the weighted mechanism 10 by being wedged between either end of the sliding detent box 21 and the spacer bars 18 and 19 respectively.

When so assembled, the weighted mechanism 10 is slid onto the rod 13 and the lower O-ring 15 is then placed on the rod 13. The natural spring of the side frames 5 and 6 hold them apart, allowing a steel ball 11 to be placed in the detent hole 7 on side frame 5 when it is held so that the side frame 5 is horizontal and the inner side of the side frame 5 is up. Then the weighted mechanism 10 on the rod 13 is slid so that the detent hole 21*c* of the sliding detent box 21 is over the steel ball 11. The weighted mechanism 10 is then pressed so that the steel ball 11 is trapped between the detent hole 7 in the side frame 5 and the detent hole 21*c* in the sliding detent box 21. Then the other steel ball 12 is placed on the other detent hole 21*d* of the sliding detent box 21, the other side frame 6 is pressed down so that the steel ball 12 is trapped between detent hole 8 in side frame 6 and the detent hole 21*d* in the sliding detent box 21. The grip pallet members 9*a* and 9*b* are attached by means of screws 9*c* and 9*d*, securing the side frames 5 and 6 in position and maintaining the weighted mechanism 10 in place.

The weighted mechanism 10 functions as follows. When the player grasps the gripper plates 16 and 17 and pushes the weighted mechanism 10 toward the head 2 of the racquet 1 or pulls the weighted mechanism 10 toward the grip 9, the gripper plates 16 and 17 and the cross-shaped cam 20 move in unison, compressing either spring 24 or 25 respectively; but the sliding detent box 21 does not initially move, and the steel balls 11 and 12 do not move out of the detent holes 7 and 8 in the side frames 5 and 6 until the wider transverse parts 20*b* and 20*d* of the cross-shaped cam 20 pass the steel balls 11 and 12 and the narrower longitudinal parts 20*e* and 20*f* of the cross-shaped cam 20 are opposite the steel balls 11 and 12. At that point the balls 11 and 12 are no longer wedged by the transverse parts 20*c* and 20*d* of the cam 20 into the detent holes 7 and 8 in the side frames 5 and 6. Consequently, the balls 11 and 12 and the sliding detent box 21 start to move in the desired direction propelled by the compressed coil spring 24 or 25. As soon as the weighted mechanism 10 is in the desired position and the balls 11 and 12 have gone into the corresponding detent holes 7 and 8 in the side frames 5 and 6, the spring-loaded weighted mechanism 10 is released by the player's hand and the mechanism recoils, allowing the wider transverse parts 20*b* and 20*d* of the cross-shaped cam 20 to again wedge the balls 11 and 12 between holes 7 and 8 and detent holes 21*c* and 21*d* in sliding detent box 21, respectively.

The racquet 1 can be made of any of the usual materials but metal framed racquets are preferred. Aluminum and steel are the usual metals for racquet frames. The weighted mechanism 10 can be made of any suitable material or combination of materials. Metals such as steel and aluminim are preferred, but some parts may be made of plastic. In the weighted mechanism 10 illustrated, all parts were made of aluminum except the balls 11 and 12, springs 24 and 25 and screws 22 and 23, which were steel. The rod 13 was steel.

The weight of the weighted mechanism 10 was approximately 3 oz. The head and side frames totaled approximately 11 oz. The prototype grip pallets 9*a* and 9*b*, machined from aluminum, totaled approximately 14 oz. The relative weights of the parts can be readily changed to achieve a racquet to suit any, even the professional, tennis player.

The rod 13 is preferably present in the racquet 1, but need not be. If it is not present appropriate modifications of the weighted mechanism 10 might have to be made. Obviously, the O-rings 15 would have no rod 13 to be placed upon and in their stead, rubber plugs might be placed on the base of the head 2 and the top of the grip 9.

Other variations and modifications may be made within the scope of this invention, and portions of the improvements may be used without others.

What is claimed is:

1. A tennis racquet comprised of (a) a head, a handle and a grip, with the handle comprised of two side frames, (b) a weighted mechanism slidably mounted between the two side frames, (c) ball and detent means comprised of a series of correspondingly placed detent holes in the side frames adjacent to the sides of the weighted mechanism and a ball positioned between each side frame and the adjacent side of the weighted mechanism, (d) means for readily maintaining the position of the weighted mechanism at intermediate positions between the head and grip comprised of cam means in which the cam is cross-shaped and is slidably located in a detent box, which in turn is slidably located within the weighted mechanism, said box having a detent hole on each side and said box being spring-loaded longitudinally against the ends of the weighted mechanism, said cross-shaped cam being attached at the intersection of the two arms of said cross to the gripper plates of the weighted mechanism, so that the cam moves in unison with the gripper plates when said weighted mechanism is moved in the direction of the head or grip of the racquet by manually gripping said gripper plates, but the detent box is delayed in moving in said direction, thereby allowing each ball, which at rest was maintained in a detent in the adjacent side frame by the transverse cross-arm of the cross-shaped cam, to recede further into the corresponding detent hole in the detent box as movement brings the longitudinal section of the cross-shaped cam opposite the detent hole of the detent box; and the spring-loading of the detent box bringing the transverse cross-arm of said cross-shaped cam adjacent to each ball thereby forcing each ball into the detent in the side frame adjacent to it and maintaining the weighted mechanism where it is located between head and grip when the manual movement is stopped.

2. A tennis racquet as claimed in claim 1 in which there is additionally present (e) a rod of uniform cross section which is longitudinally located between the two side frames and on which the weighted mechanism slides by means of a longitudinal passage of similar cross section as that of the rod.

3. A tennis racquet as claimed in claim 1 in which there are resilient bumpers on that part of the head and that part of the grip against which the ends of the weighted mechanism impact as limits to the travel of the weighted mechanism.

* * * * *